US005746439A

United States Patent [19]

Boehm et al.

[11] Patent Number: 5,746,439

[45] Date of Patent: May 5, 1998

[54] SPACER-PLATE ARRANGEMENT FOR SKI BINDINGS

[75] Inventors: Alfred Boehm, Polling; Edwin Lehner, Farchant; Werner Messerschmidt, Garmisch-Partenkirchen, all of Germany

[73] Assignee: Marker Deutschland GmbH, Germany

[21] Appl. No.: 383,464

[22] Filed: Feb. 3, 1995

[30] Foreign Application Priority Data

Feb. 3, 1994 [DE] Germany ..... 44 03 192.0

[51] Int. Cl.[6] ..... A63C 5/07

[52] U.S. Cl. ..... 280/602; 280/607

[58] Field of Search ..... 280/601, 602, 280/607, 617, 618, 633

[56] References Cited

U.S. PATENT DOCUMENTS 5,211,418 5/1993 Scherübl ..... 280/618

5,397,149 3/1995 Couderc et al. ..... 280/602

FOREIGN PATENT DOCUMENTS 0 492 658 A1 1/1992 European Pat. Off. .

41 24 965 A1 2/1992 Germany .

91 16 875 U 4/1994 Germany .

*Primary Examiner*—Richard M. Camby

*Attorney, Agent, or Firm*—D. Peter Hochberg; Mark Kusner

[57] ABSTRACT

A spacer-plate arrangement that influences the vibration behavior of a ski. The spacer-plate arrangement having a rear spacer-plate part with a flexurally rigid, plate-type flat continuation portion that projects into a cutout on the front spacer-plate part.

14 Claims, 4 Drawing Sheets

SPACER-PLATE ARRANGEMENT FOR SKI BINDINGS

FIELD OF THE INVENTION

The present invention relates generally to a spacer-plate arrangement for ski bindings. More particularly, the present invention relates to a spacer-plate arrangement for influencing the vibration behavior of the ski, the arrangement having a rear spacer-plate part, which can be mounted between the heel piece of a ski binding and the upper side of the ski, and a front spacer-plate part, which can be mounted between the toe piece of a ski binding and the upper side of the ski.

BACKGROUND OF THE INVENTION

Spacer-plate arrangements for ski bindings are known in the prior art. In this respect, prior art spacer-plate arrangements are comprised of plate-like shell or grid parts consisting of firm, impact-resistant plastic. Prior art spacer-plate arrangements make it possible to arrange the ski-binding parts at a relatively large distance from the upper side of the ski. This arrangement is regarded as advantageous by expert skiers, in particular ski racers, in terms of both the speed which can be achieved and the improved maneuverability.

European Patent No. EP 04 92 658 A1 teaches the arrangement of one ski binding heel piece and one ski binding toe piece on a common carrier plate. One end of the carrier plate is secured on the ski such that it cannot move in the longitudinal direction of the ski. The other end of the carrier plate is arranged so that it can move in the longitudinal direction of the ski, it being possible to change or restrict this capacity for longitudinal movement to a greater or lesser extent. Accordingly, the bending properties of the ski and the vibration behavior thereof upon upwards and downwards bending of the ski ends can be modified.

SUMMARY OF THE INVENTION

According to the present invention there is provided a relatively flexurally rigid, plate-type flat continuation arranged on one of a pair of spacer-plate parts. The one plate-type flat continuation projects into a cutout on the other spacer-plate part and interacts in a damping and/or frictionally locking manner with the other spacer-plate part, upon upwards and/or downwards bending of the ends of the ski.

According to the present invention there is provided a spacer-plate arrangement that damps vibrations of the ski. Upon bending of the central longitudinal region of the ski, which accompanies upwards and downwards bending of the ends of the ski, the spacer-plate arrangement provides an additional resistance that has to be overcome, at least in certain areas.

According to a preferred embodiment of the present invention there is provided one of a pair of spacer-plate parts having a continuation portion. The continuation portion interacts with the other spacer plate part by frictional locking. In this respect, the displacement movements of the continuation portion relative to the other spacer-plate part upon bending of the ski causes more or less pronounced sliding friction with a corresponding damping effect, with respect to bending vibrations and/or bending movements of the ski.

By virtue of a wedge-shaped arrangement of the sliding surfaces on the continuation portion, the surface pressing between said sliding surfaces and the mating sliding surfaces of the other spacer-plate part can differ depending on the displacement. For instance, when the sliding surfaces on the continuation are arranged as a double wedge, and extreme upwards bending and extreme downwards bending of the ends of the ski occurs, increased damping occurs.

In contrast, when the sliding surfaces on the continuation portion are arranged as a single wedge, a different damping behavior will be exhibited upon upwards and downwards bending of the ends of the ski. Moreover, the wedge form may also result in no friction, or only a negligible amount of friction, arising in certain areas.

According to another preferred embodiment of the present invention, there is provided a friction-surface part of the continuation portion and/or mating-friction-surface part configured similarly to an eccentric, which tries to pivot under the friction between friction surface and mating friction surface, and thereby changes the surface pressing or frictional force (which is normal to the friction surface) between friction surface and mating friction surface. In this respect, a pronounced friction resistance can be produced in movement in one direction of the friction surface relative to the mating friction surface, and a virtually imperceptible friction resistance can be produced in movement in the opposite direction of the friction surface of the continuation portion relative to the mating friction surface.

According to yet another preferred embodiment of the present invention, there is provided a provision for changes in the frictional force between friction surfaces and mating friction surfaces depending on the bending of the ski. In this respect, the friction surfaces and mating friction surfaces are arranged on the upper side and underside of the continuation portion. Increasing or decreasing pressure takes place when the continuation tries to pivot about a transverse axis of the ski relative to the other spacer-plate part. This occurs when the ski is bent to a relatively pronounced extent with respect to its transverse axis.

According to a further preferred embodiment of the present invention, there is provided a spacer-plate having a hydraulic damper arranged between the continuation of one spacer-plate part and the other spacer-plate part.

According to still another preferred embodiment of the present invention, there is provided a spacer-plate having a frequency-selective damping material between the continuation of one spacer-plate part and the other spacer-plate part. Accordingly, the vibration behavior of the ski is influenced in a correspondingly selective manner.

It is an object of the present invention to widen the possible applications of spacer-plate arrangements.

It is another object of the present invention to provide a spacer-plate arrangement which damps bending vibrations of a ski.

It is yet another object of the present invention to provide a spacer-plate arrangement which damps bending movements of the ski.

A further object of the invention is to damp vibrations in a ski using friction between moving components of spacer plate arrangements of a ski binding, during flexing and counterflexing of the ski.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof and wherein.

DETAILED DESCRIPTION OF THE PREFERRED EMBODIMENT

Figure 1:
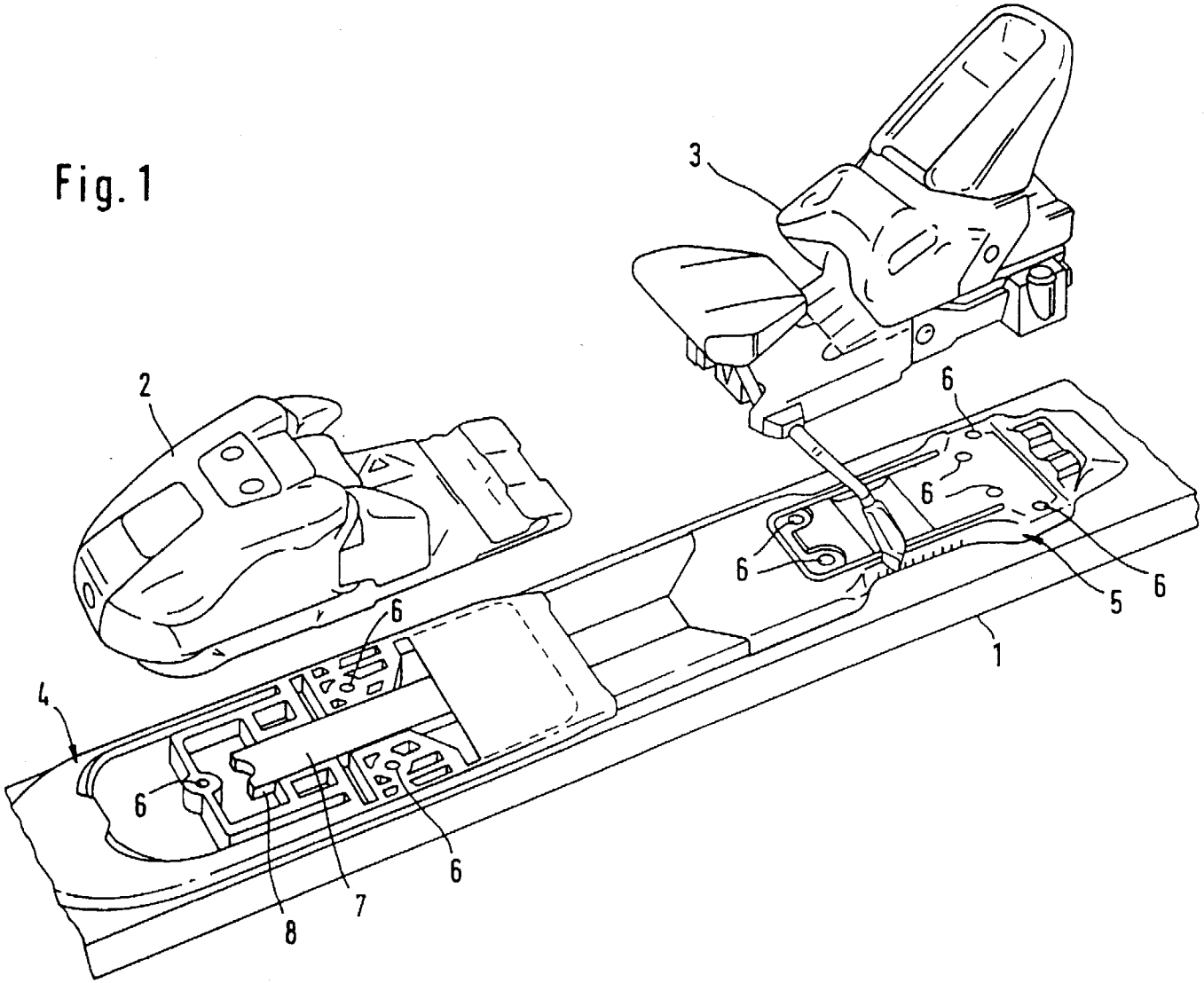
FIG. 1 is an exploded, perspective view of the central longitudinal region of a ski with ski-binding parts and a spacer-plate arrangement according to a preferred embodiment of the invention.

Referring now to the drawings wherein the showings are for the purpose of illustrating preferred embodiments of the invention only, and not for the purpose of limiting same.

FIG. 1 shows a conventional ski binding toe piece or part 2 and a similar conventional ski binding heel piece or part 3 provided on the central region of a ski 1. Ski binding parts 2 and 3 are arranged on the ski with the interposition of a front spacer-plate part 4 and a rear spacer-plate part 5 between ski binding parts 2 and 3 and the upper side of ski 1. Spacer-plate parts 4 and 5 may be mounted together with the respective ski binding parts 2 and 3. In this respect, spacer-plate parts 4 and 5 are secured by the screws provided for securing ski binding parts 2 and 3 on ski 1. Spacer-plate parts 4 and 5 have corresponding bores 6 for receiving the fastening screws of ski binding parts 2 and 3. In the mounted state, the spacer-plate parts 4 and 5 are thus secured, respectively, in the region of ski binding parts 2 and 3 such that they cannot move relative to the upper side of the ski.

A continuation portion 7 having lateral friction surfaces 8 is arranged to extend from rear spacer-plate part 5. Continuation portion 7 projects into a corresponding cut-out region of spacer-plate part 4 and is guided, by lateral friction surfaces 8, between mating friction surfaces 9 on front spacer-plate part 4, such that continuation portion 7 can be displaced against the frictional resistance. When ski 1 bends, with upwards and/or downwards bending of the ends of the ski, continuation portion 7 is displaced, in the longitudinal direction of the ski, relative to front spacer-plate part 4. Accordingly, friction surfaces 8 of continuation portion 7 and mating friction surfaces 9 of front spacer-plate part 4 interact in a frictional manner to provide friction resistance, which correspondingly must be overcome. The friction resistance damps bending vibrations of ski 1.

Figure 2:
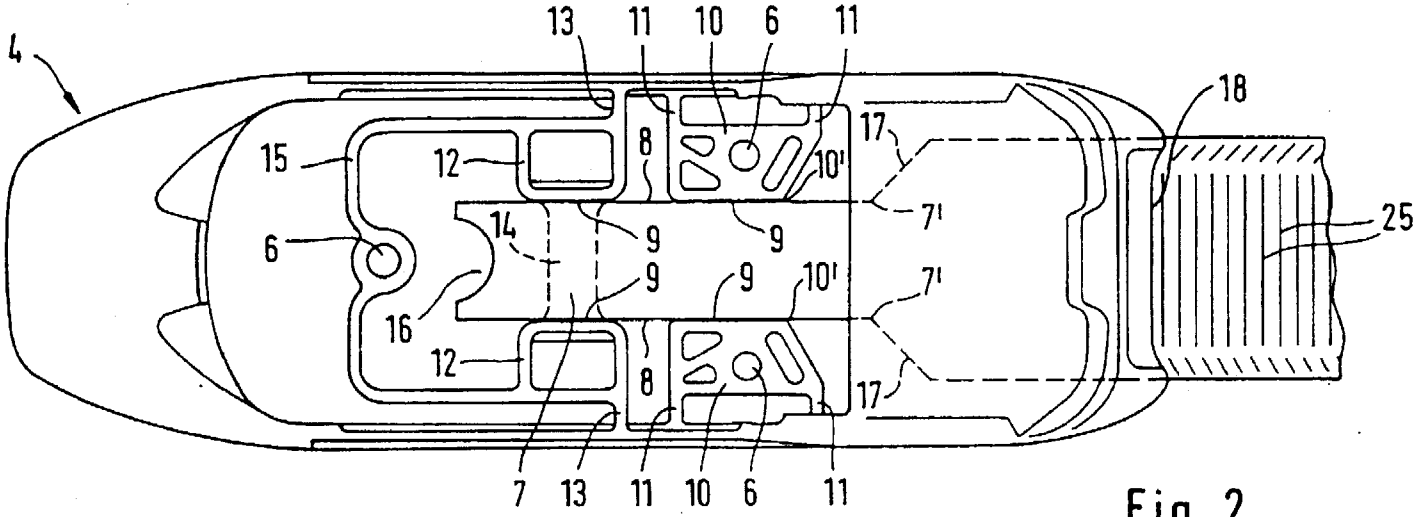
FIG. 2 is a top plan view of the front spacer-plate part and the continuation of the rear spacer-plate part of the embodiment shown in FIG. 1.

Referring now to FIG. 2, a preferred embodiment of front spacer-plate part 4 is shown in plan view. Front spacer-plate 4 forms a frame with an essentially rectangular opening, the shape of which is adapted to correspond with the underside of ski binding toe piece 2. In the mounted state, the frame gives the impression of being a continuation of ski binding toe piece 2.

Brake-block-like elements 10 are formed within the aforementioned rectangular opening, and are connected via webs 11 to the respectively adjacent longitudinal side parts of spacer-plate part 4. Brake-block-like elements 10 include mating friction surfaces 9. The tipper sides of the brake-block-like elements 10 serve as bearing surfaces for ski binding toe piece 2. Brake-block-like elements 10 are fixed, when the ski binding toe piece 2 is mounted on the ski, by the fastening screws thereof, which pass through screw bores 6 formed in brake-block-like elements 10.

Web parts 12 are rectangular in plan view and include transverse webs that continue into webs 13. Webs 13 adjoin web parts 12 and the longitudinal-side parts of spacer-plate part 4. Moreover, web parts 12 are connected to each other by a flat band 14 which, in the mounted state of the spacer-plate part 4, bears on the upper side of the ski. Web parts 12 also include mating friction surfaces 9.

A web 15 adjoins the longitudinal webs of web parts 12, which are adjacent to the longitudinal-side parts of spacer-plate part 4. Web 15 is essentially U-shaped in plan view, and in its central region includes an eyelet for a screw bore 6.

The upper edges of all the aforementioned webs and/or web parts 11 to 13 and 15 serve to vertically support ski binding toe piece 2.

In the mounted state, only U-web 15 having screw bore 6 and the brake-block-like elements 10 having the other screw bores 6, are retained by fastening screws of ski binding toe piece 2, such that they are virtually absolutely fixed to the ski. In contrast, the remaining elements of spacer-plate part 4 have a more or less high degree of compliance. In this respect, spacer-plate part 4 is comprised of a plastic which, although firm and impact-resistant, is not absolutely rigid.

Continuation portion 7 of rear spacer-plate part 5 has a front, narrow portion with a rectangular cross-section. The longitudinal sides of the rectangular cross-section form friction surfaces 8 and interact with mating friction surfaces 9 of spacer-plate part 4. In order for continuation portion 7 to be displaceable far towards the front end of spacer-plate part 4, an approximately semicircular cutout 16 is formed on the front end border of continuation portion 7. Semicircular cutout 16 is dimensioned to receive the eyelet of U-web 15.

It should be appreciated that even when continuation portion 7 is displaced to the maximum extent towards the front end of spacer-plate 4, cutout 16 and the above-mentioned eyelet of U-web 15 do not contact or strike against one another. In this respect, inner corners 10' of brake-block-like elements 10 serve as stops. Accordingly, inner corners 10' strike against corner regions 7', of continuation portion 7. Corner regions 7' adjoin that part of continuation portion 7 which is guided displaceably between mating friction surfaces 9. Corner regions 7' form a transition region to a wider part of continuation portion 7. Borders 17 of the transition region between the narrower and the wider part of continuation portion 7 are configured in the form of a wedge in plan view. Furthermore, borders 17 are arranged such that it is only corners 10' of brake-block-like elements 10 and corner regions 7' of continuation portion 7 which can contact or strike against one another. Borders 17 do not rest on the facing border surfaces of brake-block-like elements 10. In this respect, free spaces are formed between borders 17 and the facing border surfaces of brake-block-like elements 10. The free spaces are wedge-shaped in plan view, and out of which any snow which has passed in is forced out during displacement movements of continuation portion 7.

The wider region of continuation portion 7 is covered over by an end portion of spacer-plate part 4 located towards the rear end of spacer-plate part 4. The end portion includes a recess through which continuation portion 7 passes. The lower surface of the end portion and a transverse border 18 of the end portion may be configured to interact in a frictionally locking manner with a grooved arrangement 25 formed on the upper surface of the wider section of continuation portion 7. Accordingly, upon displacement of continuation portion 7 in the longitudinal direction, continuation portion 7 will have to overcome a further friction resistance in addition to the friction resistance between lateral friction surfaces 8 of continuation portion 7 and mating friction surfaces 9 of front spacer plate part 4. The further friction resistance can change somewhat when the ski bends, with upwards and/or downwards bending of its ski ends, since continuation portion 7, which is not connected to the upper side of the ski, does not bend along with the ski, or does so only partially. Accordingly, the contact-pressure force between continuation portion 7 and transverse border 18 of the front spacer-plate 4 changes.

Figure 3:
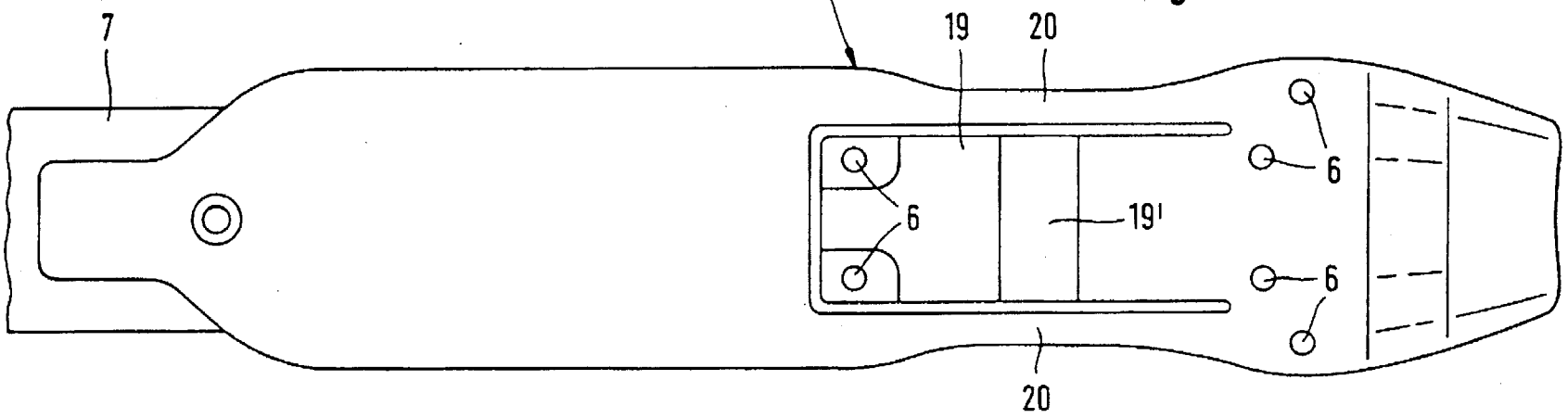
FIG. 3 is a top plan view of the rear spacer-plate part of the embodiment of FIG. 1.

Referring now to FIG. 3, a preferred embodiment of rear spacer-plate part 5 is shown. The rear end region of rear spacer-plate 5 has four screw holes 6 for receiving the fastening screws of ski binding heel piece 3. Accordingly, the rear end region of spacer-plate part 5 is secured fixedly on ski 1. A tongue portion 19 extends towards the front end region of rear spacer-plate 5. Additional screw holes 6 for ski binding heel piece 3 or ski brake thereof are arranged on the front end of tongue portion 19. A bead 19' is formed in the central region of tongue portion 19 to support the central region of tongue portion 19 on the upper side of ski 1. When ski binding heel piece 3 is mounted, tongue portion 19, as well as the rear end region of spacer-plate part 5 which adjoins tongue portion 19, are secured fixedly to ski 1, together with ski binding heel piece 3.

Rear spacer-plate part 5 also includes lateral mouldings 20 which extend in the longitudinal direction of ski 1 and are configured in a flexible manner. Lateral mouldings 20 connect the rear end region of spacer-plate part 5 to the front end region of spacer-plate part 5. The flexibility of mouldings 20 is ensured by transverse slots (not shown) provided on the underside of mouldings 20 facing the upper side of ski 1. Accordingly, the relatively rigid front end region of spacer-plate part 5 can be raised slightly from the upper side of ski 1.

The front end region of rear spacer-plate part 5 is integrally connected with continuation portion 7 or is adjustably connected to continuation portion 7 by means of a screw or the like, in order to be able to adapt the spacing of front spacer-plate part 4 and rear spacer-plate part 5 in the longitudinal direction of ski 1. Accordingly, the spacing between ski binding parts 2 and 3 is adaptable to conform to the respective ski boot size.

Figure 4:
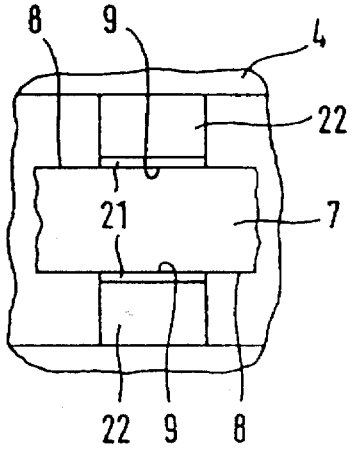
FIG. 4 is a top plan view of an alternative embodiment of the front spacer-plate part having resilient friction members interacting with the continuation portion of the rear spacer-plate part.

Referring now to FIG. 4, an alternative embodiment of front spacer-plate part 4 is shown. Mating friction surfaces 9 are arranged to the greatest extent in a rigid manner and have a certain degree of compliance only as a result of the unavoidable elasticity of the plastic material. It will be appreciated that mating friction surfaces may alternatively be arranged to be resilient. Friction elements 21 having mating friction surfaces 9 are supported on rigid and loadable regions of spacer-plate part 4 by means of elastic cushions 22. Accordingly, mating friction surfaces 9 bear on friction surfaces 8 of continuation portion 7 by a force which is predetermined by the elastic stressing of cushions 22.

Figure 5:
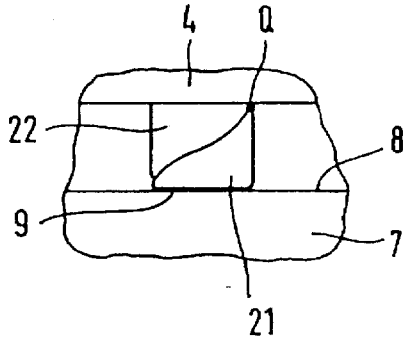
FIG. 5 is a top plan view of an alternative embodiment of the front spacer-plate part shown in FIG. 4.

Referring now to FIG. 5, there is shown an alternative embodiment of front spacer-plate part 4 shown in FIG. 4. Friction elements 21 are configured in the manner of an eccentric and are pivotable about a virtual axis Q. Accordingly, it is possible for the pivoting capacity of eccentric friction elements 21 to be formed by an easily bendable web which connects eccentric friction elements 21 to rigid and/or loadable regions of spacer-plate part 4. By means of elastic cushions 22, friction elements 21 with their mating friction surfaces 9, are, in turn, forced against friction surfaces 8 of continuation portion 7. The friction differs depending on the direction of displacement of continuation portion 7. In this respect, when continuation portion 7 is displaced forward (i.e., to the left in FIG. 5), the frictional resistance which takes place is comparatively weak because continuation portion 7, upon its forward displacement, tries to rotate friction element 21 about axis Q in the clockwise direction. Accordingly, mating friction surfaces 9 try to move away from friction surfaces 8. In contrast, when continuation portion 7 is displaced rearward (i.e., to the right in FIG. 5), friction element 21 tries to rotate in the counterclockwise direction. Accordingly, the pressing or frictional force between friction surface 8 and mating friction surface 9 is increased. In the event of a relatively weak elastic stressing of cushion 22, continuation portion 7 can move freely to the greatest extent upon forward displacement. Accordingly, forward displacement constitutes a "free-running direction".

Figure 6:
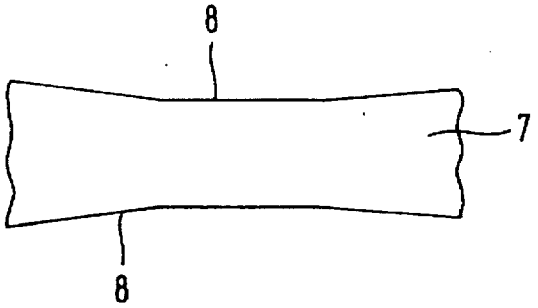
FIG. 6 is a top plan view of an alternative embodiment of the continuation portion having friction surfaces arranged in the form of a wedge.

Referring now to FIG. 6, an alternative embodiment of continuation portion 7 is shown. Friction surfaces 8 of continuation portion 7 are configured in a slightly wedge-shaped manner (i.e., a ramp-like slope), at least in certain areas, as shown in plan view. Accordingly, the friction changes, depending on the displacement path of continuation portion 7.

Alternatively, friction surfaces 8 may be formed of two wedge regions running in opposite directions. In this respect, the narrow part of continuation portion 7 has a comparatively narrow central region and widens in the form of a wedge forward (i.e., to the left) and a wedge rearward (i.e., to the right). Accordingly, the occurring friction forces will increase forward and rearward, in the event of pronounced displacement.

Figure 7:
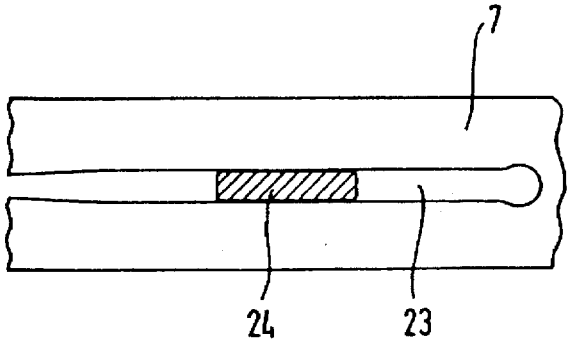
FIG. 7 is a top plan view of an alternative embodiment of the continuation portion having a longitudinal slit.

Referring now to FIG. 7, another alternative embodiment of continuation portion 7 is shown. Continuation portion 7 includes a slotted-link-type slit 23 which extends in the longitudinal direction of the ski. Slit 23 is open towards the upper side and underside of continuation portion 7. A web 24 is arranged in a stationary manner on front spacer-plate part 4 and is received into slit 23. Web 24 projects such that a displacement of continuation portion 7 can only take place on having overcome a more or less high degree of friction between the longitudinal walls of slit 23 and the facing sides of web 24.

It will be appreciated that the parts of continuation portion 7 that form the side walls of slit 23 may be configured in the manner of springs and be prestressed against web 24. Accordingly, the friction between web 24 and the walls of slit 23 may be predetermined by the spring force of the above-mentioned parts.

It will also be appreciated that slit 23 may narrow in one direction, towards its ends, or in certain areas, in order to increase the friction locally.

Figure 8:
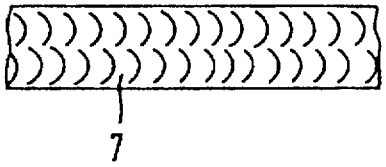
FIG. 8 is a view of a friction surface having a scaled texture.

Referring now to FIG. 8, there is shown an alternative embodiment for friction surfaces 8 and mating friction surfaces 9. In this respect, a scaled surface for friction surfaces 8 and mating friction surfaces 9 is shown. The scaled surface is similar to the running surface of a cross-country ski. Accordingly, a comparatively low friction resistance in one direction of displacement and a considerably increased friction resistance in the opposite direction of displacement may be achieved. Alternatively, friction surfaces 8 and mating friction surfaces 9 may have a grooved arrangement with a non-symmetrical profile (e.g., a roofing-tile profile). Furthermore, as shown in FIG. 2, the tipper side of the wider region of continuation portion 7 may also have a grooved arrangement 25, which interacts with transverse border 18 of spacer-plate part 4.

Figure 9:
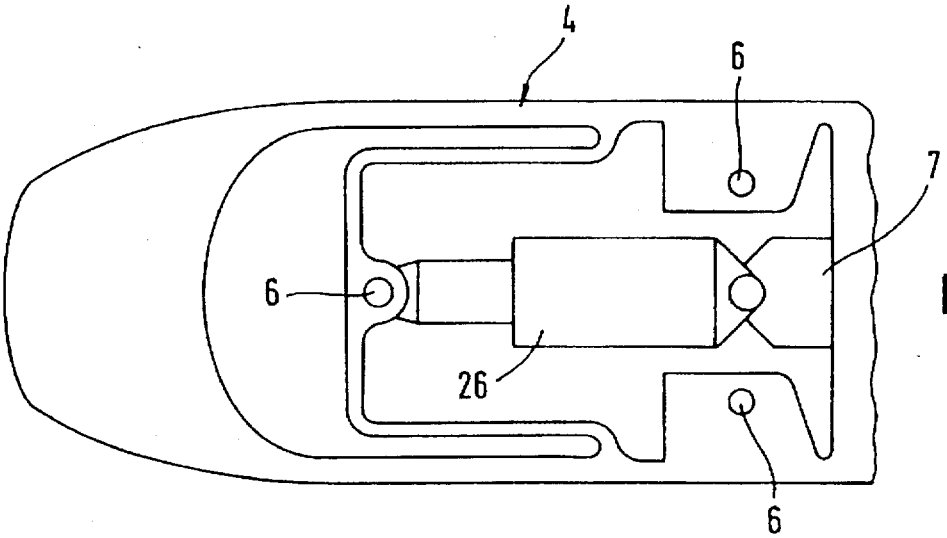
FIG. 9 is a top plan view of another embodiment of the present invention having a hydraulic damper between the continuation portion and the front spacer-plate part.

Referring now to FIG. 9, there is shown another embodiment of the present invention having a hydraulic damper unit 26 arranged between an abutment part on spacer-plate 4 and an abutment part on continuation portion 7.

Figure 10:
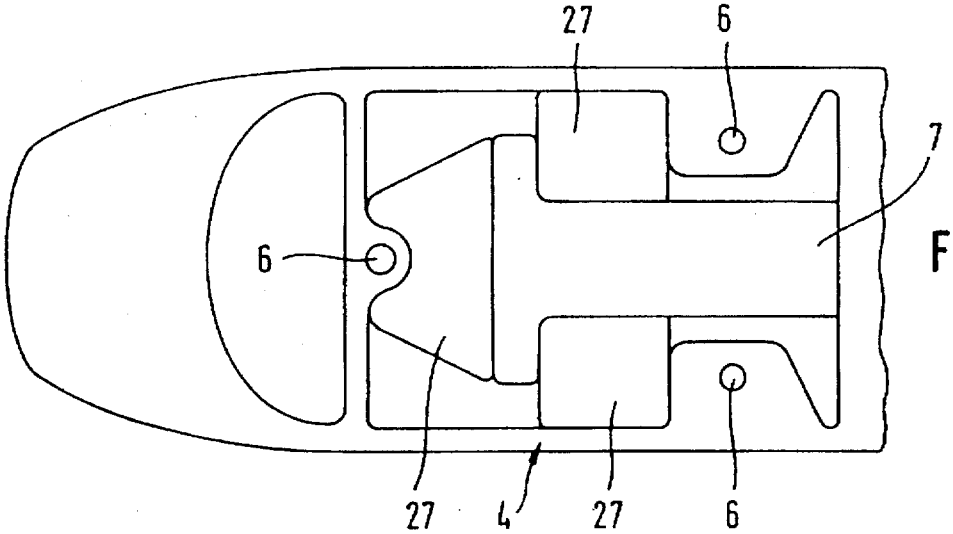
FIG. 10 is a top plan view of another embodiment of the present invention having damper material between the continuation portion and the front spacer-plate part.

Referring now to FIG. 10, there is shown another embodiment of the present invention having a frequency-selective damping material 27 (e.g., a compliant foam) acting between continuation portion 7 and spacer-plate part 4. Upon displacement of continuation portion 7, damping material 27 is subjected to thrust loading and/or tension loading and/or shear loading.

For all of the embodiments of the present invention discussed above, the damping effect may be such that a noticeable damping effect only occurs with vibrations above approximately 25 Hz. Accordingly, it is ensured that the control movements of the skier (e.g. upon the initiation of swinging actions) are transmitted successfully onto the ski. A frequency range of up to approximately 15 Hz is characteristic for these skier control movements.

The characteristic natural vibrations of the ski lies in a frequency range between approximately 15 Hz and 25 Hz. In this frequency range, natural vibrations are virtually unstimulated when skiing. However, natural vibrations are important for the ability of the ski to react to control impulses and are, to the greatest extent, to remain undamped.

Insofar as different damping values are present in dependence on the direction of movement of continuation portion 7 relative to spacer-plate part 4, it is usually expedient to provide increased damping when the ski bends with the effect of a downwards bending of the ski ends. In contrast, bending in the opposite direction (i.e., upwards bending of the ski ends) can take place in a comparatively undamped manner.

Figure 11:
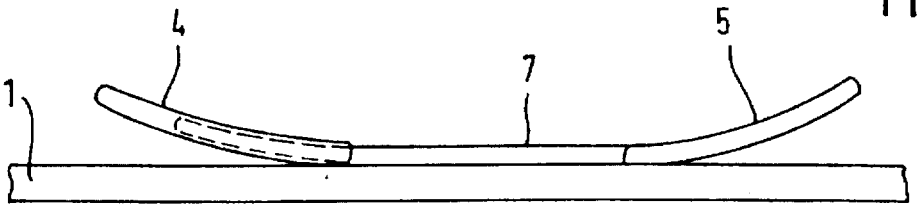
FIG. 11 is a side view of another embodiment of the present invention having a spring action in a state released from the ski.

Referring now to FIG. 11, another embodiment of the present invention is shown, wherein front spacer-plate part 4 and rear spacer-plate part 5 are connected via continuation portion 7 to form a leaf-spring-like assembly, whose ends, in a state released from ski 1, are configured such that they bend upwards (i.e., prestressed upwards) and are resilient in the manner of a leaf spring. If the ends, i.e., spacer-plate parts 4 and 5, are fastened on the upper side of ski 1, then the regions of ski 1 near the fastenings are prestressed upwards and the central region of ski 1 lying therebetween is prestressed downwards. Accordingly, the central region of ski 1 bears on the underlying surface with an increased ground pressure. Likewise, the ground pressure of ski 1 in the region of the ski near the fastenings, or spacer plates 4 and 5, via which the weight of the skier is transferred onto the ski, is correspondingly reduced. This is advantageous when skiing on an icy piste using the edges of the ski transversely to the slope, or when skiing through depressions in the ground. Moreover, in the desired manner, an upward bending of the ski ends tends to be facilitated, whereas reverse bending is delayed.

As long as the ski adopts the normal, straight travelling position, then the leaf-spring-like assembly, formed by spacer-plate parts 4 and 5 and continuation portion 7, is under elastic prestressing (in the state mounted on the upper side of the ski), since the ends of the assembly bear on the ski. This prestressing effects increased friction between continuation portion 7 of rear spacer-plate part 5 and front spacer-plate part 4. However, this friction becomes increasingly lower when the ends of ski 1 bends upwards, for example when skiing through depressions in the ground. Reduced friction occurs because this bending of ski 1 effects an increasing degree of release in the leaf-spring-like assembly. In the event of such bending of ski 1, continuation portion 7 can thus be pushed into spacer-plate part 4 against a decreasing friction resistance. In the event of subsequent reverse bending of ski 1 (i.e., downwards bending of the ski ends), continuation portion 7 is then drawn out of spacer-plate part 4 against increasing friction resistance. When ski 1 is bent with the effect of upwards bending of the ski ends, decreasing friction resistance and thus decreasing damping resistance become effective. The reverse bending takes place against increasing friction resistance and increasing damping resistance.

The foregoing description describes specific embodiments of the present invention. It should be appreciated that these embodiments are described for purposes of illustration only and that numerous alternations and modifications may be practiced by those skilled in the art without departing from the spirit and scope of the invention. It is intended that all such modifications and alterations be included insofar as they come within the scope of the patent as claimed or the equivalents thereof.

The invention claimed is:

1. A spacer-plate arrangement for a ski binding comprising:

a rear spacer-plate part mountable between a ski binding heel piece and the upper side of a ski;

a front spacer-plate part mountable between a ski binding toe piece and the upper side of the ski; and a relatively rigid continuation means extending from one of said spacer-plate parts towards the other spacer-plate part, and projecting into a cutout on the other said spacer-plate part, wherein when the ski bends, said continuation means moves in the longitudinal direction of the ski and interacts with said other spacer-plate part, said other spacer-plate part providing a frictional resistance to the longitudinal movement of said continuation means to dampen vibration of the ski.

2. A spacer-plate arrangement as defined in claim 1, wherein said frictional resistance varies depending upon the direction in which said ski bends.

3. A spacer-plate arrangement as defined in claim 1, wherein said continuation means only dampens vibrations of the ski at frequencies generally above 25 Hz.

4. A spacer-plate arrangement as defined in claim 1, wherein said spacer-plate arrangement further comprises an hydraulic damping means arranged between said continuation means and said other spacer-plate part.

5. A spacer-plate arrangement as defined in claim 1, wherein said continuation means is comprised of continuation friction surfaces and said other spacer-plate part is comprised of mating friction surfaces, said continuation friction surfaces interacting with said mating friction surfaces as said continuation means moves relative to said other spacer-plate part to dampen vibrations of the ski.

6. A spacer-plate arrangement as defined in claim 1, wherein said continuation means has an upper surface, said upper surface having friction surfaces cooperating with said mating friction surfaces of said other spacer-plate part to dampen vibration of the ski.

7. A spacer-plate arrangement as defined in claim 1, wherein said continuation means has an underside, said underside having friction surfaces and cooperating with said mating friction surfaces of said other spacer-plate part to dampen vibration of the ski.

8. A spacer-plate arrangement as defined in claim 6, having means for varying the frictional force between said friction surfaces of said continuation means and said mating friction surfaces depending on the state of bending of the ski.

9. A spacer-plate arrangement as defined in claim 7, having means for varying the frictional force between said friction surfaces of said continuation means and said mating friction surfaces depending on the state of bending of the ski.

10. A spacer-plate arrangement as defined in claim 5, wherein at least one of said continuation friction surfaces and said mating friction surfaces is arranged in a compliant manner.

11. A spacer-plate arrangement as defined in claim 5, wherein at least one of said continuation friction surfaces and said mating friction surfaces have a ramp-like sloping section, said ramp-like sloping section resulting in increased frictional force between said continuation friction surfaces and said mating friction surfaces upon displacement of said continuation means.

12. A spacer-plate arrangement as defined in claim 5, wherein said mating friction surfaces are comprised of eccentric-like parts for providing different frictional force between said continuation friction surfaces and said mating friction surfaces, depending upon the direction of movement of said continuation means.

13. A spacer-plate arrangement for a ski binding comprising:

a rear spacer-plate part mountable between a ski binding heel piece and the upper side of a ski;

a front spacer-plate part mountable between a ski binding toe piece and the upper side of the ski;

a relatively rigid continuation means extending from one of said spacer-plate parts towards the other spacer-plate part, and projecting into a cutout on the other said spacer-plate part; and compliant damping material arranged between said continuation means and said other spacer-plate part, wherein when the ski bends, said continuation means moves in the longitudinal direction of the ski and interacts with said damping material to dampen vibration of the ski.

14. A spacer-plate arrangement for a ski binding comprising:

a rear spacer-plate part mountable between a ski binding heel piece and the upper side of a ski;

a front spacer-plate part mountable between a ski binding toe piece and the upper side of the ski, wherein said rear and front spacer-plate parts form a spring-like assembly having end regions, said end regions prestressed in a vertical direction relative to the top of the ski; and a relatively rigid continuation means extending from one of said spacer-plate parts towards the other spacer-plate part, and projecting into a cutout on the other said spacer-plate part, wherein when the ski bends, said continuation means moves in the longitudinal direction of the ski and interacts with said end regions to dampen vibration of the ski.

* * * * *